US007485075B2

(12) United States Patent
Ghim

(10) Patent No.: US 7,485,075 B2
(45) Date of Patent: Feb. 3, 2009

(54) INTERACTIVE TRAINING DEVICE

(76) Inventor: Malthuke S. Ghim, 31 Birchwood Ter., Nanuet, NY (US) 10954

( * ) Notice: Subject to any disclaimer, the term of this patent is extended or adjusted under 35 U.S.C. 154(b) by 47 days.

(21) Appl. No.: 11/564,600

(22) Filed: Nov. 29, 2006

(65) Prior Publication Data

US 2007/0087911 A1 Apr. 19, 2007

Related U.S. Application Data

(63) Continuation-in-part of application No. 10/705,993, filed on Nov. 12, 2003, now Pat. No. 7,278,957.

(60) Provisional application No. 60/425,799, filed on Nov. 13, 2002.

(51) Int. Cl.
*A63B 69/34* (2006.01)

(52) U.S. Cl. ..... 482/83; 482/84

(58) Field of Classification Search ..... 482/83–90, 482/148, 102, 106

See application file for complete search history.

(56) References Cited

U.S. PATENT DOCUMENTS 6,110,079 A * 8/2000 Luedke et al. ..... 482/83
6,435,937 B1 * 8/2002 Naegele ..... 446/298

* cited by examiner

*Primary Examiner*—Jerome Donnelly
(74) *Attorney, Agent, or Firm*—Williams Mullen; Sangwon S. Kim

(57) ABSTRACT

An apparatus is provided for an inflatable sound generating interactive training device for a trainee in martial arts. The apparatus includes an inflatable body, wherein an impact sensor switch is configured to generate audible sound via a speaker in response to a predetermined level of impacts to the body. A connecting member has a helical spring coil that is resiliently coupled to a connecting rod. The apparatus also includes a base for ground support with the body, wherein the sound generating module is coupled in the base, wherein the base is connected with the body by utilizing the connecting member, wherein the connecting rod projects vertically for securely supporting the base, wherein a speaker, the impact sensor switch and the sound generating module are electrically connected through the connecting rod.

14 Claims, 6 Drawing Sheets

INTERACTIVE TRAINING DEVICE

RELATED APPLICATION

This application is a Continuation-In-Part (CIP) of U.S. patent application Ser. No. 10/705,993 filed on Nov. 12, 2003 now U.S. Pat. No. 7,278,957, entitled "Sports Training Device," which claims the benefit of the Nov. 13, 2002 filing date of U.S. Provisional Application Ser. No. 60/425,799, all of which are incorporated by reference.

FIELD OF THE INVENTION

Embodiments of the invention relate to a training device, and more particularly to an inflatable interactive training device.

BACKGROUND

Conventional training device is formed of material which is hermetically sealed, yet be capable of withstanding strong impacts. When strong impacts are delivered to a body, the body may then swing to a degree where instead of swinging back, the heavy body will resist firmly. This low bounce characteristics associated with heaviness of the body may not absorb impact repulsion that may cause sprain wrists or ankles, especially for young trainees. Also, the external surfaces are usually tensed and stiff so that a realistic feeling experienced during exercising cannot be obtained.

In addition, the conventional punching device is filled with sand or stuffed with clothing material. Such heavy materials do not permit ease of movement of the device. Thus, with the conventional punching device, the user (e.g., children or novices) cannot practice exercises that promotes agility—e.g., hitting moving targets.

In addition, conventional training devices lack effective means for providing feedback to the users.

Accordingly, the need exists for an interactive training device that can provide a range of training activities.

SOME EXEMPLARY EMBODIMENTS

These and other needs are addressed by the claimed subject matter in which an apparatus is provided for an inflatable, sound generating interactive training device. The interactive training device includes a sound generating module, a connecting member, an inflatable body and a base.

According to one aspect of an embodiment of the invention, an apparatus for a training device is disclosed. The apparatus comprises an inflatable body configured to receive impacts, wherein an impact sensor switch coupled to the body to generate a signal in response to a predetermined threshold impact receiving to the body. The apparatus further comprises a connecting member configured to support the inflatable body, wherein a spring is engaged to a connecting rod and the engaged connecting member is fixedly connected to the body. The apparatus further comprises a base configured to support the body, wherein the engaged connecting member projects vertically to securely support the base and the body, wherein a sound generating module is coupled to the impact sensor switch to generate a sound according to a signal by the impact sensor.

In another aspect of an embodiment of the invention, a method for making an interactive training device is provided. The method comprises configuring an impact sensor switch within an inflatable body, wherein the inflatable body is resiliently engaged to a base using a connecting member. The method comprises determining whether the impact reaches a predetermined threshold. The method further comprises moving a sensor position in an actuated position wherein a sound is generated by a speaker in responsive to a signal transmitted by the impact sensor switch when the impact reaches to the predetermined threshold. The method further comprises returning the sensor position to a disabled position, wherein the impact sensor switch disconnects the signal transmitted to the speaker. The method comprises generating a sound by a sound generating module actuated by the signal from the impact sensor switch in responsive to the predetermined threshold.

In yet another aspect of an embodiment of the invention, an interactive training apparatus for providing audible sound is provided. The apparatus includes an inflatable body configured to receive an impact is resiliently engaged with a base using connecting member. The interactive training apparatus includes an impact sensor switch configured to determine the impact whether to reach to a pre-determined threshold, wherein the impact sensor is disposed within the inflatable body. The apparatus further includes a sound generating module coupled to the impact sensor configured to receive a signal transmitted and to send the signal to a speaker to generate audible sound.

Still other aspects, features, and advantages of the embodiments of the invention are readily apparent from the following detailed description, simply by illustrating a number of particular embodiments and implementations, including the best mode contemplated for carrying out the embodiments of the invention. The invention is also capable of other and different embodiments, and its several details can be modified in various obvious respects, all without departing from the spirit and scope of the invention. Accordingly, the drawing and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings and in which like reference numerals refer to similar elements and in which.

DESCRIPTION OF THE PREFERRED EMBODIMENT

An apparatus for providing a sound generating inflatable training device is described. In the following description, for the purposes of explanation, numerous specific details are set forth in order to provide a thorough understanding of the present invention. It is apparent, however, to one skilled in the art that the present invention may be practiced without these specific details or with an equivalent arrangement. In other instances, well-known structures and devices are shown in block diagram form in order to avoid unnecessarily obscuring the present invention.

Figure 1:
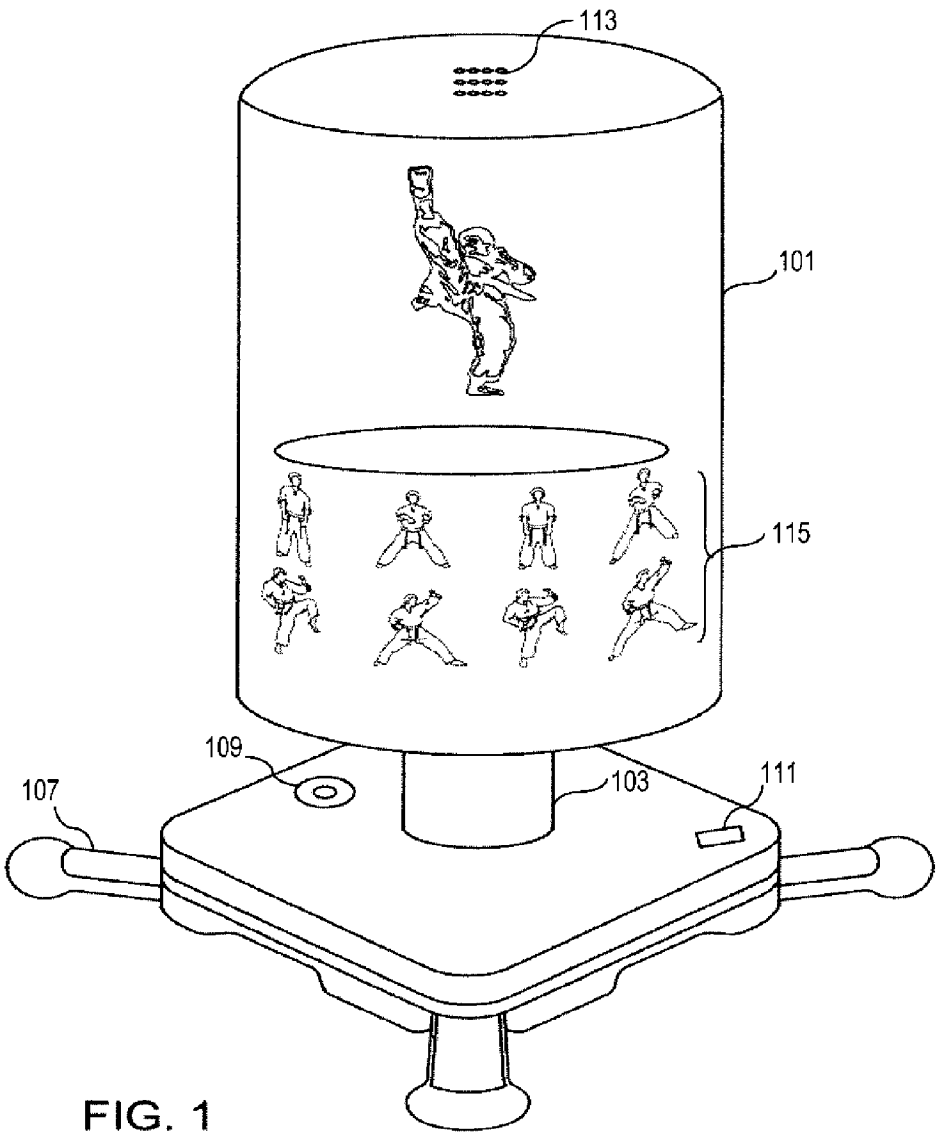
FIG. 1 is a diagram of an interactive training device, in accordance with an embodiment invention.

FIG. 1 is a diagram showing a front view of an interactive training device in accordance with an embodiment of the present invention. The training device includes an inflatable body 101, a connecting member 103 and a base 105 with extensible legs 107. An on/off switch 111 is positioned on the base 105. An inlet 109 is disposed for filling water or sand in the base 105. The body is shaped and graphically decorated 115 with suggested proper training and exercise techniques.

Figure 2:
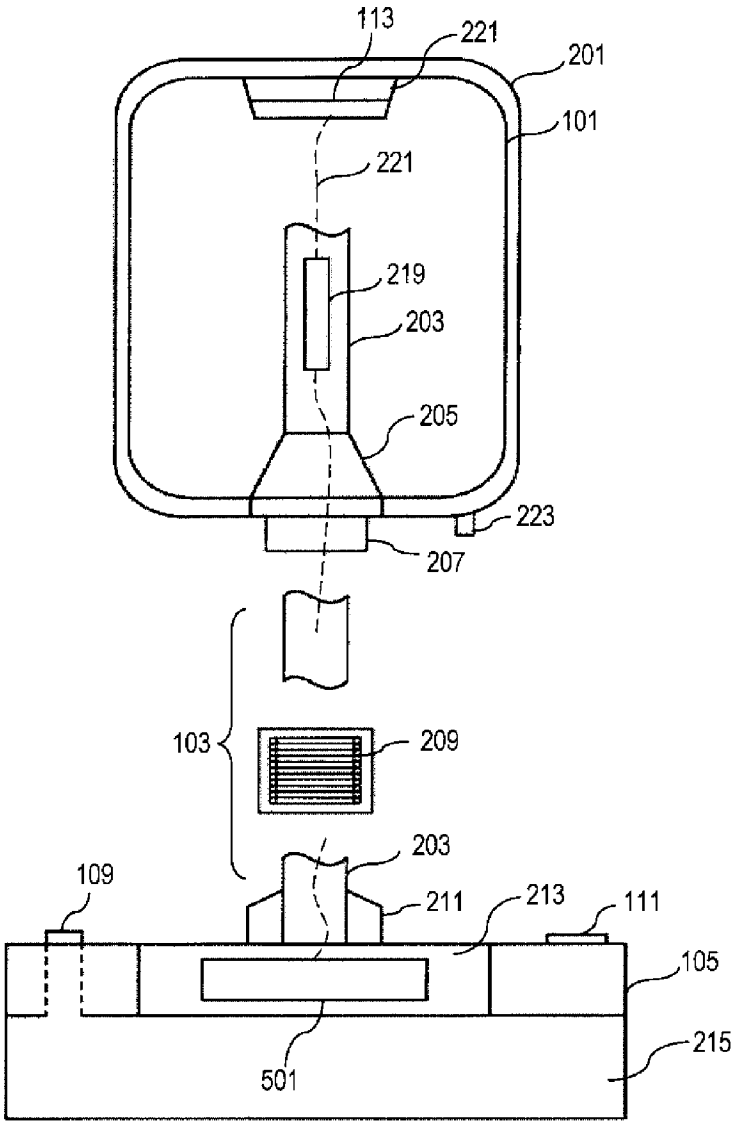
FIG. 2 is a diagram of a sectional view of the interactive training device of FIG. 1, ding to an embodiment of the present invention.

FIG. 2 is a diagram showing a sectional view of the interactive training device of FIG. 1, according to an exemplary embodiment. An outer casing 201 of the body 101 is formed by contoured segments of high strength, stretchable fabric material to create a desired shape when the casing 201 is fully expanded. The inflated body 101, which can be inflated by an air pressure through inlet 223, exhibit good bounce characteristics. The higher the internal bag pressure, the greater is its reaction to impact (e.g., punching or kicking), and the lower the pressure, the more the bag absorbs this impact.

Since the body 101 is inherently weak, the casing 201 does not permit many region of the balloon to further expand beyond its existing degree of expansion; hence, the body 101 will not burst even if the balloon absorbs a strong impact. Therefore, the body 101 is made of air-impermeable material such as synthetic plastic fibers, and the casing 201 can be fabricated of a high-strength, non-stretchable fabric, such as a woven fabric formed of cotton, canvas or synthetic plastic fibers, such as nylon or polyester.

Connecting members 103 include a connecting rod 203 that is inserted into a receiving case 205 formed with a supportive plate of the body 207. The connecting members 103 also include a helical spring 209 which is engaged into each end of the connecting rods 203. The connecting rod 203 being engaged into the spring 209 is inserted into a receiving case 203 of the base 105.

The connecting member 103 is firmly jointed by two receiving cases (211 and 205). In this regard, when a trainee punches the body 101, the body 101 is caused to swing to a degree that depend on the force of the punch, the body 101 then swinging back to resume its erect position.

The engaging rod 203 can extend vertically from a top of the body 101 to the bottom of the base 105. The body 101 and the base 105 have opposed ends in order to define the extending points. It is noted that the helical spring 209 can be engaged into the connecting rod 203 sufficiently tight to prevent disengagement from the connecting rod 203 when receiving impact. It is contemplated that various elastic characteristics of springs can be used according to strengths and skills of a trainee. Therefore, when the body 101 is subjected to a strong punch, the body 101 has some degree of flexibility (depending on the spring constant of the spring 209) to swing away from the vertical axis and return to the vertical position.

When engaging the connecting rod 203 into the helical spring 209, soldering or brazing can be used as exemplary methods for such engagement. Soldering can be performed in a number of ways, including passing parts over a small fountain in a bulk container of molten solder (wave soldering), heating assemblies by use of an infrared lamp, or by using a point source such as an electric soldering iron, a brazing torch, or a hot-air soldering tool.

is also noted that the distinction between soldering and brazing is arbitrary, with the only difference being the melting temperature of the filler material. For example, a temperature of 450° C. is usually used as a practical cutoff. Different equipment and/or fixturing is usually required since (for instance) most soldering irons cannot achieve high enough temperatures for brazing. Practically speaking, there is a significant difference between the two processes—brazing fillers have far more structural strength than solders, and are formulated for this as opposed to maximum electrical conductivity. Brazed connections are often as strong or nearly as strong as the parts they connect, even at elevated temperatures. "Hard soldering" or "silver soldering" (performed with high-temperature solder containing up to 40% silver) is also often a form of brazing, since they involve filler materials with melting points in the vicinity of, or in excess of, 450° C.

As shown in FIG. 2, the base 105 includes a receiving case 211 formed with a supportive plate (not shown) through which the engaged connecting member (connecting rod 203 and engaged helical spring 209) is securely fixed. By way of example, the base 105 can be divided into an upper part and lower part. The upper part has a room 213 for receiving the sound generating module 500. The module 500 can electrically be configured to connect to the speaker 113. When a trainee turns on an on/off switch 111, a sound is generated when an impact sensor switch 219 detects a predetermined degree of force in responsive to the impact receiving to the body 101. A speaker 113 is mounted on the receiving portion 221 that is attached to the top of the inside of the body 101 that is aligned with the connecting rod 203 to facilitate wiring 221 and transmission of sounds. The lower part includes a container 215 and a cap 109 which is used to close the inlet after the container 215 is filled with sand or water so that the base securely supports the body 101. The impact sensor switch 219 is housed within the body 101 for determining a predetermined degree of force in response to an impact delivered to the body 101 by a trainee.

Figure 3A:
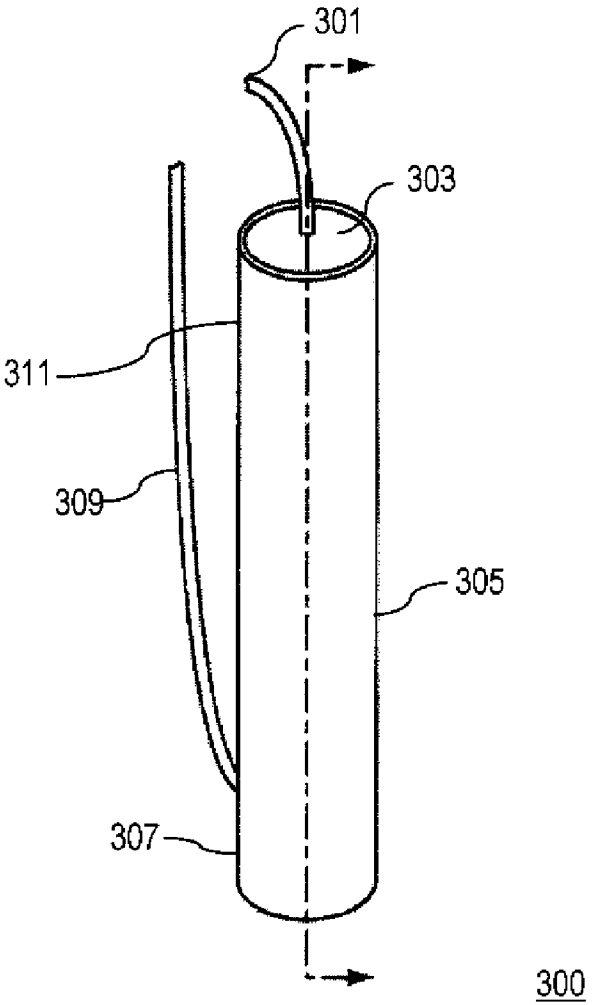
FIG. 3A is an impact sensor switch resident in the interactive training device, according to an embodiment of the present invention.

FIG. 3A is an impact sensor switch utilized in an interactive training device for sensing impacts, according to an embodiment of the present invention. An impact sensor switch 300 is electrically connected to the sound generating module 500. The impact sensor switch 300 can be mounted within anywhere of the body 101 (e.g., from between the lower portion of the body 101 and the higher portion of the body 101 according to the levels of strength impacts that can be adjusted by a trainee). The impact sensor switch 300 is adapted to the sound generating module 500 to determine threshold of a predetermined strength that cause the sound generating module 500 to transmit electrical signal to the speaker 113 for generating pre-programmed audible sounds. The impact sensor switch 300 has an elongated housing 305 including an opening 373, which extends through the housing 305, and a pair of opposing ends 307, 311. End caps 353, 363 are mounted to the ends 307, 311 respectively, of the housing 305 for closing off same. A contact ring 361 is fixedly mounted in the opening 373 of the housing 305 adjacent end 307, while a contact assembly 377 is mounted in the opening 373 of the housing 305. The contact assembly 377 includes a substantially rigid wire 357 having a pair of ends 355, 371 and made from a conductive material. (e.g., steel). A contact plate 365 is attached to the end 371 of the wire, while an adjustment plate 375 is attached to the wire 357 adjacent the end 355. More particularly, the wire 357 extends through the adjustment plate 375 and is supported in the opening 373 of the housing 359 by the adjustment plate 375 such that the contact plate 365 is normally out of contact with the contact ring 361. The wire 357 is provided with sufficient flexibility and the contact plate 365 is provided with sufficient weight such that the contact plate 365 is engageable with the contact ring 361 in response to impact delivered to the body 101. An electrical wire extends through the housing and is connected to the connecting ring, while an electrical wire 309 extends through the housing 305 and is connected to the contact ring 361, while an electrical wire 301 extends through the end cap 303 and is connected to the end 355 of the wire 357. The electrical wires 301, 309 connect the impact sensor switch 300 to the sound generating member 500.

Figure 3B:
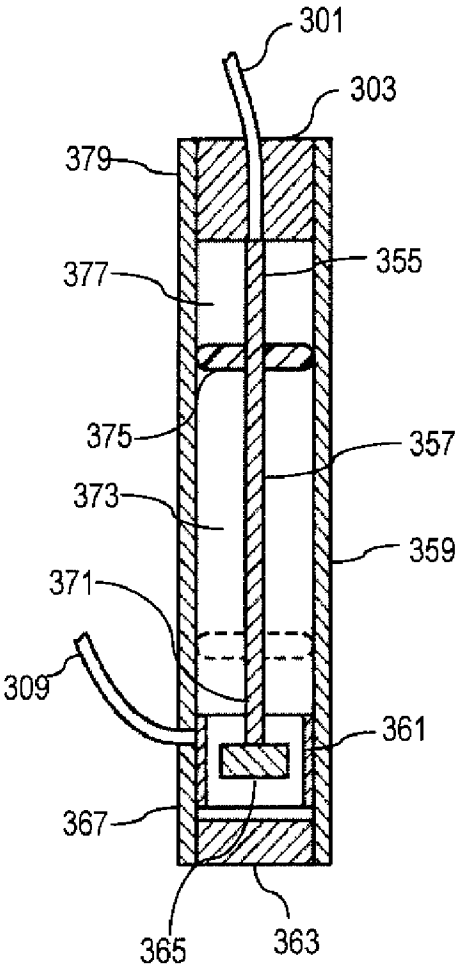
FIG. 3B is a sectional view of the impact sensor shown in FIG. 3A, according to an embodiment of the present invention.

FIG. 3B is a sectional view of the impact sensor shown in FIG. 3A, according to an embodiment of the present invention. The adjustment plate 375 is movably mounted in the opening 373 of the housing 305. More particularly, the adjustment plate 375 is movable on said wire 357 such that it can be set at one of a plurality of positions along at least one portion of the wire 357 so as to control the sensitivity or impact threshold of the impact sensor switch 300. For instance, when the adjustment plate 375 is positioned in close proximity to the contact ring 361 (as indicated by the broken line representation of the adjustment ring 375 in FIG. 3A), a greater force or impact is required to cause the contact plate 365 to come in contact with the contact ring 361. When the adjustment plate 375 is positioned toward the end 355 of the wire 357(as indicated by the solid line representation of the adjustment plate 375 in FIG. 3B), less force or impact is required to cause the contact plate 365 to come in contact with the contact ring. In this manner, by adjusting the position of the adjustment plate 375, the desired sensitivity of the impact sensor switch 300 can be selected.

The adjustment plate 375 is adapted to form a friction fit with the inner wall of the housing 359 such that the adjustment plate 375 can be maintained at one of the plurality of positions along the wire 357 between the ends 355 and 371.

In operation, the on/off switch 111 is positioned in its "on" position. When an impact (e.g., a kick or punch) is delivered by an athlete to the body 101, the contact plate 365 moves in response thereto and comes in contact with the contact ring 361, thereby closing or completing the associated switch circuit of the generating module 500. As a result, the generating module 500 sends electrical signals to the speaker 113 which, in turn, converts the signals into audible sounds, thereby making the experience of martial arts training fun and entertaining. The audible sounds can include a variety of sounds, such as human voices providing training instructions. It can be noted that the impact sensor switch 300 can also be replaced with different types of switches adapted to be in a closed condition when it senses impact to the shield.

Figure 4:
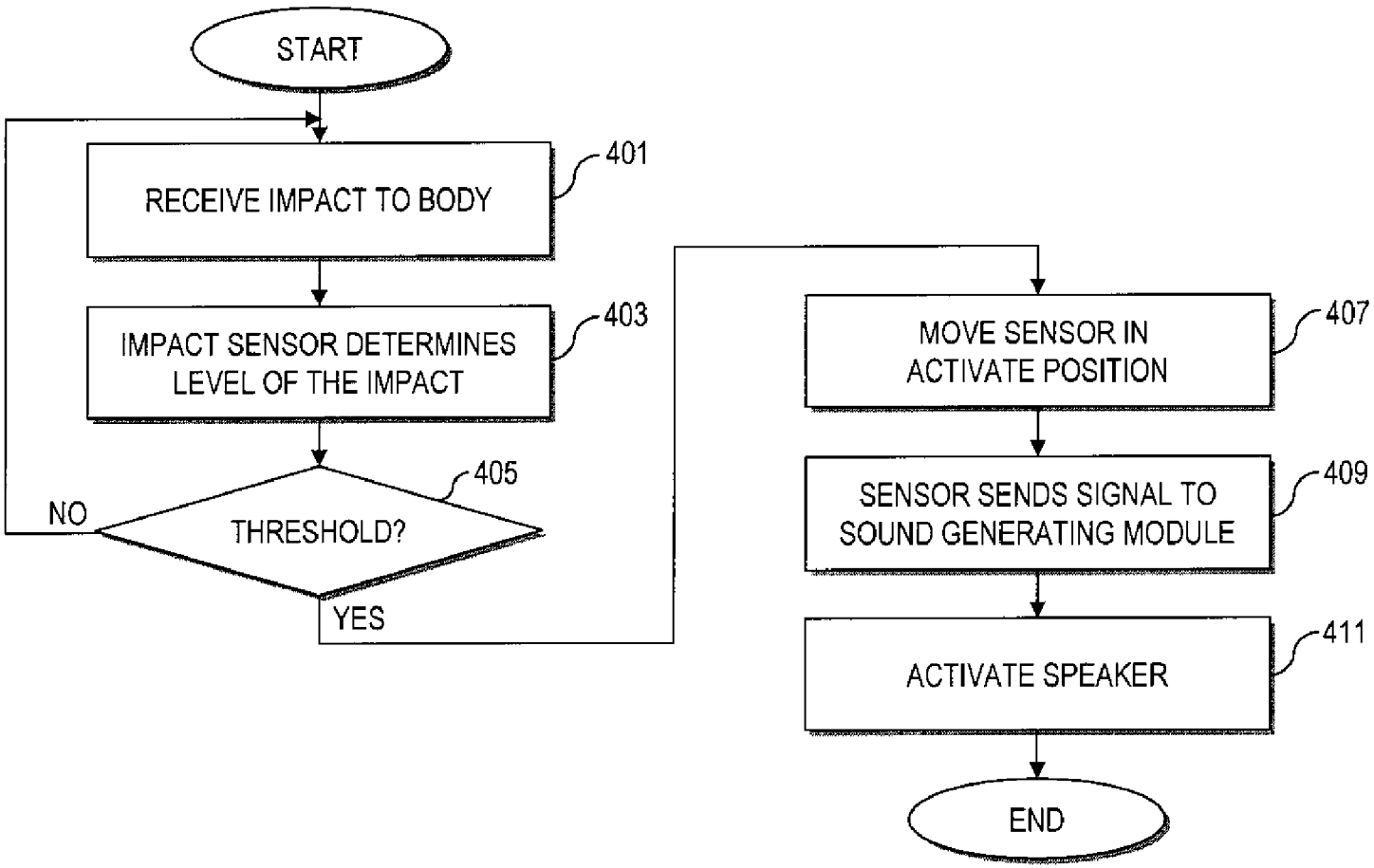
FIG. 4 is a flowchart of processes for sound generation, in accordance with various embodiments of the invention.

FIG. 4 is a flowchart of a process for generating a sound associated with the generating sound module and the impact sensor switch, in accordance with an embodiment of the present invention. In step 401, an inflatable body receives impacts to the body. When receiving the impact, per step 403, an impact sensor disposed in the body determines the level of the impact whether the impact reaches, per step 505, to a predetermined threshold set by a user. When the impact sensor determines the threshold, the sensor position is moved to an activate position (per step 407), wherein the impact sensor transmits, in step 409, the signal to a sound generating module and the sound generating module transmit (per step 411) a signal to cause generate a sound via speaker.

Figure 5:
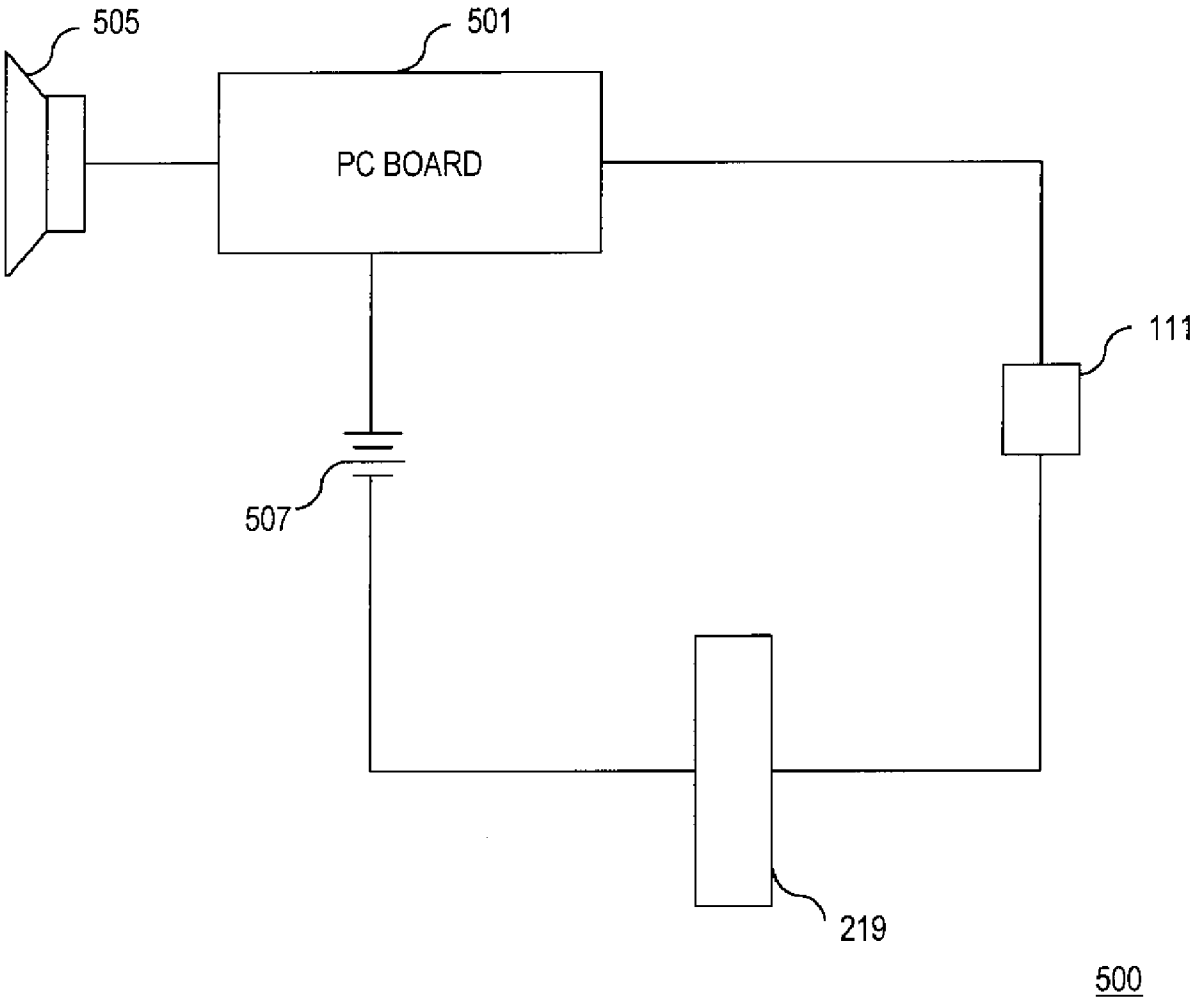
FIG. 5 is a diagram of hardware that can be used to implement an embodiment of the invention, according to an embodiment of the invention.

FIG. 5 is a diagram of sound generating module 500, according to an exemplary embodiment. With reference to FIG. 2, the PC board 501 of a sound generating module 500 resides within the upper part room 213 for generating predetermined audible sounds in response to an impact delivered by an athlete. More particularly, the sound generating module 500 includes a PC board 501 (i.e., a microprocessor) equipped with a plurality of conventional electronic components. The PC board 501 is preferable positioned in the room 213 toward the upper surface. The module 500 further includes an on/off switch 111 (see also FIGS. 1 and 2) is connected to the PC board 501 and is mounted. The sound generating module 500 also includes a speaker 505 connected to the PC board 501. The speaker 505 is mounted within the cover 113 (see FIG. 1) and is attached to the lateral side of the receiving portion 221 such that it is generally aligned with the impact sensor switch 219 (see FIG. 1) to facilitate the transmission of sounds therefrom. A power source 507 (e.g., a battery or batteries) is also connected to the PC board 501 for supplying electrical power thereto.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. An interactive training apparatus, comprising:

an inflatable body configured to receive an impact, wherein an impact sensor switch is coupled to the body to generate a signal in response to a predetermined threshold of impact, wherein the impact sensor switch includes an elongated housing having an opening extended along with inside of the housing and a resilient wire is configured along with the extended opening to resiliently contact to a contact ring, wherein the resilient wire has a contact plate attached at the end of the resilient wire and an adjustment plate is movably mounted to the resilient wire and the contact plate is attached to the end of the resilient wire to contact the contact ring based on the applied impact, wherein the predetermined threshold can be controlled by positioning the adjustment plate;

a connecting member configured to support the inflatable body; and a base configured to support the connecting member and the inflatable body, wherein a spring is configured to resiliently engage the inflatable body with the base, wherein a sound generating module is configured to generate a sound in response to the signal by the impact sensor.

2. An apparatus according to claim 1, wherein the impact sensor switch includes a movable switch capable of moving to actuate according to predetermined positions that include a first position to actuate the signal and a second position to disable the signal, wherein the sensor of the impact sensor switch can return to the second position automatically.

3. An apparatus according to claim 1, wherein the predetermined threshold can be set by a user according to a desired sensitivity of the impact sensor switch associated with levels of impacts.

4. An apparatus according to claim 1, wherein the connecting member includes connecting rods, a receiving case, a supportive plate and a spring, wherein the spring is fixedly engaged to the connecting rods, and the upper part of the engaged connecting rod is jointly inserted into the body to support the body through the receiving case, and the bottom part of the engaging rod is jointly inserted into the base.

5. An apparatus according to the claim 1, the sound generating module is further configured to electronically connect to the impact sensor and to the speaker through which to transfer audible signal.

6. A method for making an interactive training device, the method comprising:

configuring an impact sensor switch within an inflatable body, wherein the inflatable body is resiliently engaged to a base using a connecting member, wherein the impact sensor switch includes an elongated housing having an opening extended along with inside of the housing and a resilient wire is configured along with the extended opening to resiliently contact to a contact ring, wherein the resilient wire has a contact plate attached at the end of the resilient wire and an adjustment plate is movably mounted to the resilient wire and the contact plate is attached to the end of the resilient wire to contact the contact ring based on the applied impact, wherein a predetermined threshold can be controlled by positioning the adjustment plate;

determining whether the implied impact reaches the predetermined threshold; and generating a sound by receiving the signal transmitted from the impact sensor switch to a speaker in response to the predetermined threshold.

7. A method according to claim 6, wherein the impact sensor switch includes a movable switch capable of moving to actuate according to predetermined positions that include a first position to actuate the signal and a second position to disable the signal, wherein the sensor of the impact sensor switch can return to the second position automatically.

8. A method according to claim 6, wherein the connecting member includes connecting rods, a receiving case, a supportive plate and a spring, wherein the spring is fixedly engaged to the connecting rods, and the upper part of the engaged connecting rod is jointly inserted into the body to support the body through the receiving case, and the bottom part of the engaging rod is jointly inserted into the base.

9. A method according to the claim 6, the sound generating module is further configured to electronically connect to the impact sensor and to the speaker through which to transfer audible signal.

10. An interactive training apparatus, comprising:

an inflatable body configured to receive an impact is resiliently engaged with a base using connecting member;

an impact sensor switch configured to determine the impact whether to reach to a pre-determined threshold, wherein the impact sensor switch includes an elongated housing having an opening extended along with inside of the housing and a resilient wire is configured along with the extended opening to resiliently contact to a contact ring, wherein the resilient wire has a contact plate attached at the end of the resilient wire and an adjustment plate is movably mounted to the resilient wire and the contact plate is attached to the end of the resilient wire to contact the contact ring based on the applied impact, wherein the predetermined threshold can be controlled by positioning the adjustment plate; and a sound generating module coupled to the impact sensor configured to receive a signal transmitted and to send the signal to a speaker to generate audible sound.

11. An apparatus according to claim 10, wherein the connecting member includes connecting rods, a receiving case, a supportive plate and a spring, wherein the spring is fixedly engaged to the connecting rods, and the upper part of the engaged connecting rod is jointly inserted into the body to support the body through the receiving case, and the bottom part of the engaging rod is jointly inserted into the base.

12. An apparatus according to claim 10, the predetermined threshold can be set by a user according to a desired sensitivity of the impact sensor switch associated with different levels of the impact, wherein a sensor position of the impact sensor can move to an actuated position in response to the threshold is reached, and the sensor position automatically can be returned to a disabled position.

13. An apparatus according to claim 10, the sound generating module is further configured to connect to the impact sensor and to the speaker through which to transfer audible signal.

14. An apparatus according to claim 13, the audible signal can be pre-programmed in a memory resided at the sound generating module and can generate in a order as programmed or randomly.

* * * * *